United States Patent [19]

Poldervaart

[11] Patent Number: 4,527,501

[45] Date of Patent: Jul. 9, 1985

[54] MOORING SYSTEM CARRIED OUTBOARD BY A RIGID ARM ON A VESSEL

[75] Inventor: Leendert Poldervaart, La Turbie, France

[73] Assignee: Single Buoy Moorings, Inc., Marly, Switzerland

[21] Appl. No.: 511,197

[22] Filed: Jul. 6, 1983

[30] Foreign Application Priority Data

Jul. 7, 1982 [NL] Netherlands ..... 8202738

[51] Int. Cl.[3] ..... B63B 21/50

[52] U.S. Cl. ..... 114/230

[58] Field of Search ..... 441/3-5; 114/230; 141/279, 387, 388

[56] References Cited

U.S. PATENT DOCUMENTS 3,407,768 10/1968 Graham ..... 441/5 X
3,602,175 8/1971 Morgan et al. ..... 175/7
3,677,302 7/1972 Morgan ..... 441/3

FOREIGN PATENT DOCUMENTS 2376022 7/1978 France .

*Primary Examiner*—Sherman D. Basinger
*Attorney, Agent, or Firm*—Young & Thompson

[57] ABSTRACT

Floating system comprising a ring shaped body with structure for connecting anchor chains. The ring shaped body is rotable around a vertical axis in relation to the floating system. Fluid conduits extend downwards from the floating system through the ring shaped body and are connected to a rotatable conduit coupling. The rotatable conduit coupling is installed on the floating system above the ring shaped body by a cardan joint with two horizontal axes, which cardan joint is located at the outside of the conduit coupling. The ring shaped body has an inner central opening of such large dimensions that the conduits or hoses running from conduit coupling downwards through that opening are maintained free of the ring shaped body in each angular position allowed by the cardan joint.

1 Claim, 2 Drawing Figures

MOORING SYSTEM CARRIED OUTBOARD BY A RIGID ARM ON A VESSEL

The invention relates to a floating system comprising a ring shaped body with means for connecting anchor chains, which ring shaped body is rotatable around a vertical axis in relation to the floating system, and comprising furthermore fluid conduits running from said floating system downwards through said ring shaped body and connected to a rotatable conduit coupling installed on said floating system above the ring shaped body.

Such a system is commonly known for instance from the Dutch Patent Application No. 65,05345 which is laid open to public inspection, and in the U.S. Pat. No. 3,366,982.

The floating system according to said Dutch Patent Application No. 65,05344 comprises a tanker, the bow of which carries a forwardly extending arm, rigidly connected to said bow, in which arm a device is installed, rotatable around a vertical axis, to which device anchor chains are connected and through which device conduits extend which under the water level are embodied as hoses and which conduits above the arm through a rotatable coupling are connected to conduits running to the tanker. Therefore the tanker can swivel around the anchoring arrangement.

The system described in U.S. Pat. No. 3,366,982 comprises a buoy in which a ring shaped rotatable body is mounted by means of bearings, which body carries the anchor chains and through which body conduits extend which underneath the buoy are embodied as hoses and which conduits through a rotable coupling are connected to conduits running to ships to be moored to the system.

In all floating systems, comprising fluid conduits which are embodied, partly or completely as hoses, one has the problem that the movements of the floating system caused by waves result in dangling movements of the hoses causing early wear of said hoses. Said problem is especially significant when the floating system is displaced under the influence of wind and waves, whereby the hoses may come into conflict with the inner walls of the passage in the ring shaped body and/or with the anchor chains. The object of the invention is to solve this problem.

According to the invention a solution for this problem is obtained in that the rotatable conduit coupling is installed on the floating system by means of a cardan joint with two horizontal axes, which cardan joint is positioned at the outside of the conduit coupling and in that the ring shaped body has an inner central opening of such large dimensions that conduits or hoses running from the coupling through said opening downwards are maintained free of said ring shaped body in each angular position allowed by the cardan joint. Because the conduit coupling is supported by means of a cardan joint there is no relation anymore between the movements of the floating system and the conduits. Therefore the life of the poorly accessible submerged conduits or hoses is extended significantly. The conduits extending above the water level from the rotatable conduit coupling, which in general extend to the storage spaces of the floating system are in this case subject to stronger movements, however said conduits or hoses are easily accessible.

The invention will be explained in more detail with reference to the drawing.

FIG. 1 illustrates a rigid arm 1, connected to a non-illustrated tanker and for instance extending from the bow thereof in forward direction in a well known way.

Figure 1:
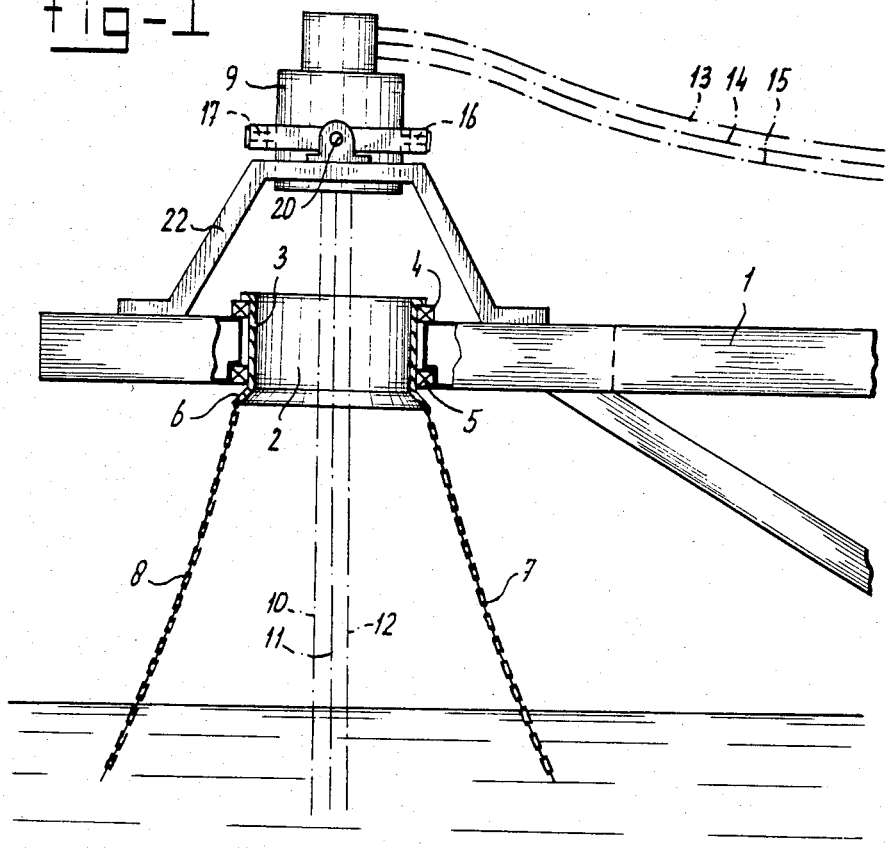
FIG. 1 shows in a side view, partly in cross section, of a system according to the invention.
Figure 2:
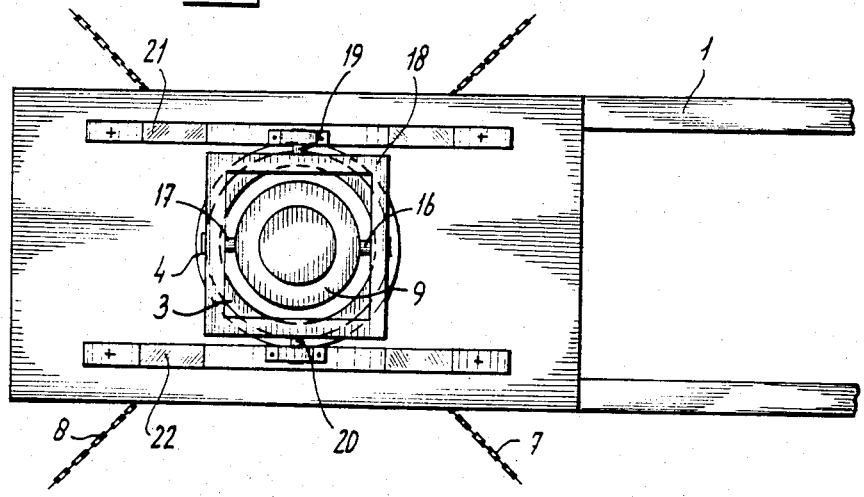
FIG. 2 shows a top plan view of FIG. 1.

Said arm 1 has a large opening 2, in which the ring shaped body 3 is supported on bearings 4 respectively 5, which ring shaped body has at the underside thereof a flange 6 for connecting the anchor chains 7 and 8 thereto.

Above the rigid arm and especially centrally above the opening 2 a conduit coupling 9 is installed to which the downwards extending hoses 10, 11 and 12 are connected and to which furthermore at the upperside the hoses 13, 14 and 15 are connected.

The conduit coupling 9 is rotatably supported in a subframe 18 by means of the horizontal pivots 16 and 17 and said subframe 18 is by means of the pivots 19 and 20 supported on two trestles 21 and 22 positioned on the arm 1.

The floating system has the ability to carry out movements, caused by wind and waves around three mutually perpendicular axes and to carry out movements in the horizontal plane. The conduit coupling will under the influence of the weight of the conduits or hoses 10–12 hanging thereon be maintained in position and because of the presence of the cardan joint the conduit coupling 9 is able to move in relation to the arm 1 of the floating system so that the hoses or conduits 10–12 are essentially kept free of any movement.

The ring shaped body 3 has an opening of such dimensions that the hoses 10–12 will not come into contact with said ring shaped body 3 if the system is displaced in the horizontal plane.

I claim:

1. In a mooring system comprising a vessel, an arm rigidly connected to said vessel and extending outboard, said arm carrying a ring-shaped body having a vertical axis, said body being rotatable with respect to said arm about said vertical axis, anchor chains connected to said ring-shaped body, said ring-shaped body having a central opening through which extend conduits running downward from a rotatable conduit coupling mounted above said central opening on said arm; the improvement in which said conduits are connected to said conduit coupling so as to follow the movements of the coupling, a rigid frame rigidly mounted on said arm and extending above said ring-shaped body and its central opening, said frame at opposite sides of the central opening carrying pivot pins on which the outer member of a cardan joint rotates about a first horizontal axis, said outer member carrying pivot pins on which is mounted, for rotation about a second horizontal axis perpendicular to said first axis, that part of the conduit coupling to which are connected the downwardly extending conduits, the cardan joint supporting the conduit coupling for rocking movement about said horizontal axes but preventing movement of the conduit coupling along said vertical axis relative to said arm, the central opening of the ring-shaped body being sufficiently large that, during movements of the rigid arm of the vessel, the said downwardly extending conduits are kept substantially free from contact with the ring-shaped body.

* * * * *